US006477255B1

(12) United States Patent
Yoshida et al.

(10) Patent No.: US 6,477,255 B1
(45) Date of Patent: Nov. 5, 2002

(54) AUDIO SYSTEM

(75) Inventors: Minoru Yoshida; Fumio Matsushita, both of Saitama-ken; Satoshi Kumada, Tokyo; Yoshiki Ohta, Saitama-ken, all of (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/368,348

(22) Filed: Aug. 5, 1999

(30) Foreign Application Priority Data

Aug. 5, 1998 (JP) ..... 10-233591

(51) Int. Cl.[7] ..... H04B 1/00; H03G 3/00

(52) U.S. Cl. ..... 381/86; 381/302; 381/63; 381/61

(58) Field of Search ..... 281/302, 300, 281/307, 61, 63, 86, 365, 17, 18, 19

(56) References Cited

U.S. PATENT DOCUMENTS 4,866,776 A * 9/1989 Kasai et al. ..... 381/86
4,953,219 A * 8/1990 Kasai et al. ..... 381/63
5,018,205 A * 5/1991 Takagi et al. ..... 381/86
5,325,435 A * 6/1994 Date et al. ..... 381/86
5,526,431 A * 6/1996 Shioda ..... 381/63
5,710,818 A * 1/1998 Yamato et al. ..... 381/86
5,727,067 A * 3/1998 Iwamatsu ..... 381/63

FOREIGN PATENT DOCUMENTS

JP 61-202600 * 9/1986 ..... 381/63

* cited by examiner

*Primary Examiner*—Xu Mei
(74) *Attorney, Agent, or Firm*—Arent Fox Kintner Plotkin & Kahn

(57) ABSTRACT

A rear speaker and a front speaker are provided in a room. A microphone is disposed at a listening position between the front and rear speakers for picking up a first sound from the front speakers and a second sound from the rear speaker. Time lags of the first sound and the second sound is obtained from the outputs of the microphone, and the time difference between the time lags is obtained. An antiphase audio signal opposite to a reflected composite signal included in the first sound picked up by the microphone is provided by the sound field correcting circuit. The antiphase audio signal with the same amplitude is delayed based on the time difference and emitted from the rear speaker so as to cancel the reflected composite signal.

9 Claims, 4 Drawing Sheets

AUDIO SYSTEM

BACKGROUND OF THE INVENTION

The present invention relates to an audio system, and more particularly to a system which enables to provide a uniform sound field characteristics throughout the entire listening space.

There has been known an audio system wherein:la plurality of loudspeakers are disposed in a room, thereby to provide a uniform sound field characteristics in the room.

Referring to FIG. 4, a plurality of loudspeakers 5 of an example of the conventional audio system for a motor vehicle are provided in a dashboard at the both sides thereof, doors 2 and 3, or in a rear package shelf 4. By driving; these loudspeakers 5, a uniform sound field is to be presented to passengers 6.

In order to create a uniform sound field with the conventional audio system described above, providing a plurality of speakers is not enough. It is preferable to dispose the speakers in an interior space where the wave characteristic of the sound waves such as reflection and composition can be ignored, that is, idealistically speaking, the free sound field.

However, in a limited space of the motor vehicle, the wave characteristic of the sound waves cannot be ignored. The direct sound emanated from each speaker and the reflected sound reflected from the wall of the interior is composed with each other, thereby generating a reflection composite effect. As a result, the composite sound causes the frequency response of the original music emanated from the speakers to be impaired, thereby generating a frequency component offensive to the ears called a peak or a dip in the audible frequency range.

In order to resolve such a problem, there has been proposed an audio system using a minimum number of speakers, thereby reducing the number of the sound sources themselves, which is the cause of the reflection composite effect. For the case, the speakers are disposed only at the sides of the dashboard. However, although the number of the speakers is decreased, in a space having a complicated shape such as the interior of a motor vehicle, the reflection composite effect cannot be sufficiently restrained. Due to the complicated shape of the interior space of the motor vehicle, a peak of a low frequency component is generated as a sound field characteristic, and in addition, the sound pressure level of the low frequency component is higher at a position adjacent the rear seat than at a position adjacent the front seat. As a result, the passengers at the rear seat hear a disagreeable muffled sound.

SUMMARY OF THE INVENTION

An object of the present invention is to provide an audio system which solves the problems of the conventional audio system, thus providing a uniform sound field wherein the influence of the reflection composite effect is restrained in the entire space.

According to the present invention, there is provided an audio system for a room comprising, a sound source, a first speaker for emitting a first sound including a reflected composite signal based on an audio signal from the sound source, a second speaker for emitting a second sound, a microphone disposed at a listening position between the first and second speakers for picking up the first sound from the first speaker and the second sound from the second speaker, control means for obtaining a time difference and a sound pressure difference between the reflected composite signal and the second sound picked up by the microphone based on characteristic information of the first and second sounds, phase adjusting means for inverting the phase of the audio signal from the sound source for producing an antiphase audio signal, filter means for extracting an input audio signal of a predetermined frequency band from the antiphase audio signal, in which the predetermined frequency band corresponds to a frequency band of the reflected composite signal included in the first sound picked up by the microphone, delay means for delaying the antiphase audio signal bas ed on the time difference so that the second sound coincides with the first sound at the microphone, amplitude adjusting means for adjusting the amplitude of the antiphase audio signal so as to reduce the second pressure difference, applying means for applying the inverted antiphase audio signal to the second speaker for emitting the second sound.

The present invention further provides an audio system for a room comprising, a sound source, a first speaker for emitting a first sound based on an audio signal from the sound source, a second speaker for emitting a second sound, phase adjusting means for inverting the phase of the audio signal from the sound source for producing an antiphase audio signal, filter means for extracting an input audio signal of a predetermined frequency band from the antiphase audio signal, in which the predetermined frequency band corresponds to a frequency band of a reflected composite signal included in the first sound applied to a listening position, delay means for delaying the antiphase audio signal a delay time obtained based on a time difference between a first time lag between the audio signal from the sound source and the first sound applied to the listening position, and second time lag between the audio signal from the sound source and the second sound applied to the listening position, amplitude adjusting means for adjusting the amplitude of the antiphase audio signal so as to approximate to the second pressure of the first sound, applying means for applying the inverted antiphase audio signal to the second speaker for emitting the second sound.

These and other objects and features of the present invention will become more apparent from the following detailed description with reference to the accompanying drawings.

DETAILED DESCRIPTION OF THE PREFERRED EMBODIMENT

Figure 1:
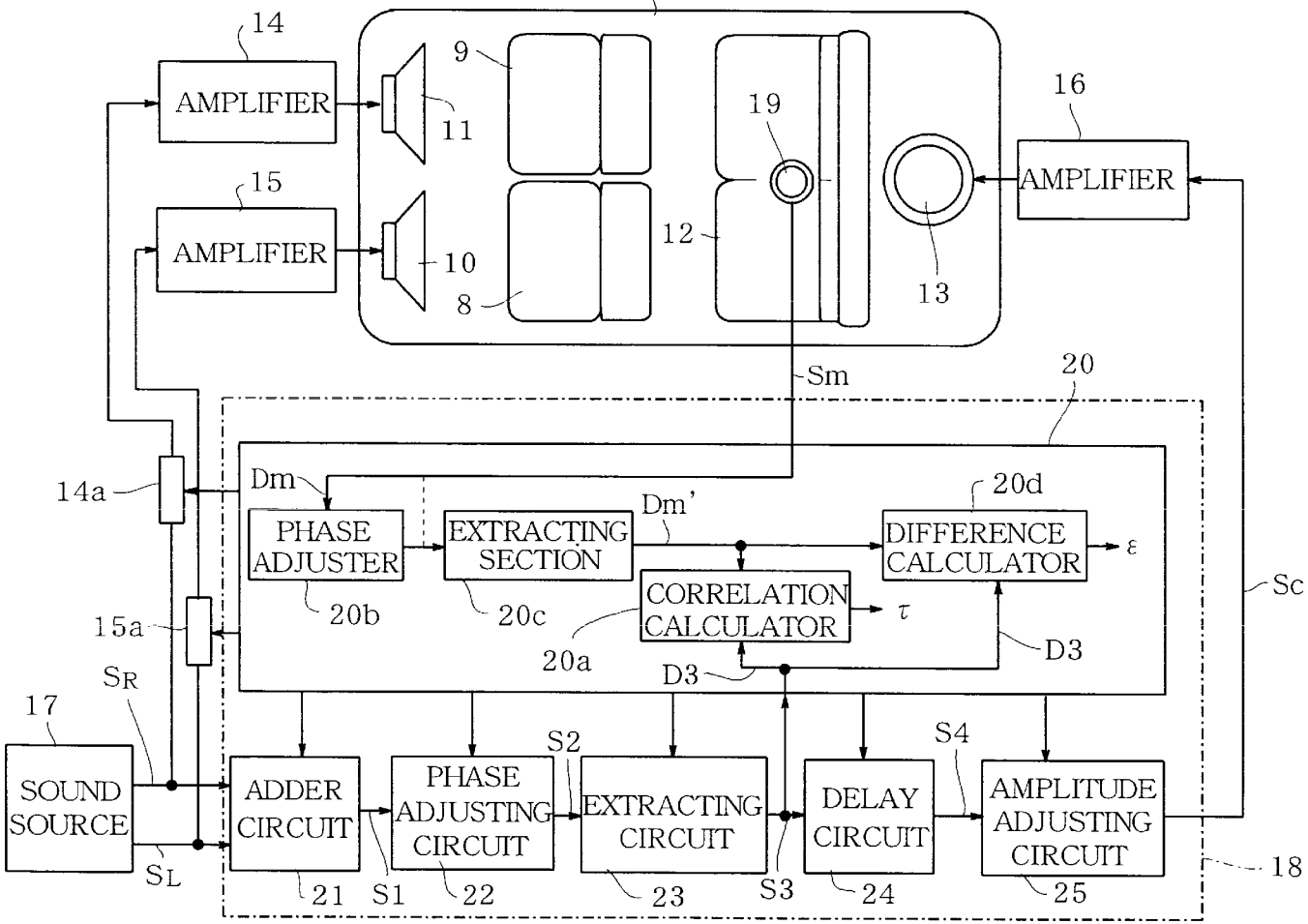
FIG. 1 is a block diagram showing an audio system according to the present invention and a schematic illustration showing an arrangement of loudspeakers in a motor vehicle.

The audio system according to the present invention is mounted on a motor vehicle as shown in FIG. 1. In an interior space 7 of the vehicle, there is provided a pair of loudspeakers 10 and 11 mounted in a dashboard at both sides thereof in front of front seats 8 and 9, respectively, for causing a stereophonic effect. Another loudspeaker 13 for correcting the sound field is mounted in a rear package shelf at a center thereof behind a rear seat 12, for example:,. Furthermore, a microphone 19 is disposed at the listening position, which is adjacent the rear seat 12. The microphone 19 picks up a first sound from the loudspeakers 10 and 11 and propagated to the listening position, or a second sound from the sound field correcting loudspeaker 13 and propagated to the listening position. Before the loudspeakers 10, 11 and 13, amplifiers 14, 15 and 16 are provided.

The audio system further comprises a sound source 17 at which audio signals $S_L$ and $S_R$ are produced. The audio signal $S_L$ is applied to the speaker 10 in the interior space 7 through a delay circuit 15*a* and the amplifier 15 to drive the speaker. Similarly, the audio signal $S_R$ is applied to the speaker 11 through a delay circuit 14*a* and the amplifier 14. The delay time at the delay circuits 14*a* and 15*a* a are usually set at zero and set at a predetermined time when required to delay the signals. The audio signals $S_L$ and $S_R$ are further applied to sound field correcting circuit 18 to generate a sound field correcting signal Sc which is fed to the sound field correcting speaker 13 disposed at the rear of the vehicle through an amplifier 16.

The sound field correcting circuit 18 comprises an adder 21, phase adjusting circuit 22, extracting circuit 23, delay circuit 24, amplitude adjusting circuit 25, and a control circuit 20 for controlling the operations of the circuits 21 to 25. The control circuit 20 comprises a phase adjuster 20*b*, extracting section 20*c*, correlation calculator 20*a*, and a difference calculator 20*d*. The control circuit 20 is operated in accordance with a system program installed in an MPU (not shown) provided therein. In the sound field correcting circuit 18, the left and right audio signals $S_L$ and $S_R$ are added together at the adder 21 to generate an added audio signal S1, which is in turn applied to the phase adjusting circuit 22. The phase adjusting circuit 22 comprises an inverting amplifier so that an antiphase audio signal S2, the phase of which is inverted is produced. The antiphase audio signal S2 is fed to the extracting circuit 23.

The extracting circuit 23 comprises a band-pass filter or a low-pass filter having a predetermined pass band BF. More particularly, the pass band BF is based on a frequency fp of a reflected composite signal which is calculated in accordance with the following equations (1) and (2). Namely, a wavelength λ of the reflected composite signal included in the first sound is obtained as follows.

$$\lambda \approx 2 \times L \tag{1}$$

where L is a length of the interior space 7. The frequency fp is further expressed as, $$fp \approx c/\lambda \tag{2}$$

where a constant c is the sound wave velocity in air. The frequency fp can be obtained when λ in the equation (2) is substituted by the equation (1).

Thus, only the frequency components of the antiphase audio signal S2 within the pass band BF is transmitted through the extracting circuit 23 and fed to the delay circuit 24 as an extracted audio signal S3. The extracted audio signal S3 is delayed for a period of time which is determined at the control circuit 20, the operation of which will be described later in detail, and fed to the amplitude adjusting circuit 25 as a delayed signal S4.

The amplitude of the delayed signal S4 is adjusted at the amplitude adjusting circuit 25 to generate the sound field correcting signal Sc. The amplitude to which the delayed signal S4 is adjusted is determined by the control circuit 20 and the operation thereof will be described later in detail.

The sound field correcting signal Sc is applied to the sound field correcting loudspeaker 13 through the amplifier 16.

The phase adjuster 20*b* of the control circuit 20 is applied with digital data Dm which is generated at an A/D converter (not shown) provided in the control circuit 20 based on an acoustic signal Sm, which is either of the first and second sounds picked up by the microphone 19 in the interior space 7. The phase adjuster 20*b* has the same function and characteristics as the phase adjusting circuit 22 and processes the digital data Dm as though the phase of the acoustic signal Sm is inverted. The inverted data Dm is applied to the extracting section 20*c* which comprises a digital filter having the same pass band BF as the extracting circuit 23. The extracting section 20*c* digitally filters the inverted digital data Dm to generate filtered digital data Dm'. The filtered digital data Dm' are fed to the correlation calculator 20*a*.

The audio signal S3 from the extracting circuit 23 is converted into digital data D3 by an A/D converter (not shown) provided in the control circuit 20 and fed to the correlation calculator 20*a*. The correlation calculator 20*a* calculates a cross correlation between the digital data Dm' and D3 to calculate a time lag τ between the data Dm' and D3 when the absolute value of the cross correlation value becomes maximum.

More particularly, the correlation calculator 20*a* calculates a time lag τ1 between the first sound (Sm) which is emitted from the speakers 10 and 11, propagated to the listening position, and picked up by the microphone 19, and the audio signal S3. Namely, the time lag τ1 corresponds to a time taken for the sound emitted from the speakers 10 and 11 to reach the listening position.

The correlation calculator 20*a* further calculates a time lag τ2 between the second sound (Sm) emitted from the speaker 13, propagated to the listening position, and picked up by the microphone 19, and the audio signal S3. Namely, the time lag τ2 corresponds to a time taken for the sound emitted from the speaker 13 to reach the listening position.

When calculating the time lag τ2, the digital data Dm' is based on the data Dm which passed through the phase adjuster 20*b* and the extracting section 20*c*. On the other hand, when calculating the time lag τ2, the data Dm' which passed through only the extracting section 20*c* and not the phase adjuster 20*b* is used.

The time lag τ1 and the time lag τ2 are applied to the delay circuit 24. The delay circuit 24 has a delay line, for example, so as to automatically set a delay time Δτ which is equal to the difference (τ1−τ2) between the lags τ1 and τ2. Hence, the audio signal S3 is delayed for the delay time Δτ.

The extracted data Dm' and the digital D3 corresponding to the extracted signal S3 from the extracting circuit 23 are further applied to the difference calculator 20*d*. At the difference calculator 20*d*, an absolute value ϵ of a difference between the square of the digital Dm' and a square of the data D3 is calculated as follows.

$$\epsilon = |(Dm')^2 - (D3)^2| \tag{3}$$

The digital data Dm' which passed through only the extracted section 20*c* and not the phase adjuster 20*b* may be used in obtaining the absolute value ϵ.

The absolute value ϵ is fed to the amplitude adjusting circuit 25 so that the amplitude of the delayed signal S4 from the delay circuit 24 is automatically adjusted so that the absolute value $\epsilon$ becomes minimum. The sound field correcting signal Sc, the amplitude of which is corrected accordingly is fed to the sound field correcting loudspeaker 13 through the amplifier 16.

The phase adjuster 20*b* and the extracting section 20*c* are adapted to be equivalent to the phase adjusting circuit 22 and the extracting circuit 23, respectively, so that when calculating the time lag $\tau 1$, that is the propagating time of the first sound, the influences of the phase adjusting circuit 22 and the extracting circuit 23 may be eliminated, thereby providing an accurate processing.

The operation of the audio system for creating a uniform sound field in the interior space 7 is described hereinafter.

The audio signals $S_L$ and $S_R$ such as music signals, are applied from the sound source 17 to the loudspeakers 10 and 11 through the amplifiers 15 and 14, respectively. At the start, the control circuit 20 temporarily stops the supply of the sound field correcting signal Sc to the sound field correcting loudspeaker 13 through the amplifier 16. Thus, a sound field caused only by the audio signals $S_L$ and $S_R$ is created in the space 7, thereby generating the first sound.

Thus, the microphone 19 picks up the first sound and applies it to the control circuit 20 as the acoustic signal Sm. At the control circuit 20, the cross correlation between the digital data Dm' and the digital data D3 is calculated. Thus, the time lag $\tau 1$ between the acoustic signal Sm and the extracted audio signal S3 is calculated. Accordingly, the time it takes for the reflected composite signal emitted from the loudspeakers 10 and 11 included in the first sound to reach the listening position is obtained.

While the sound field correcting loudspeaker 13 is turned off, the direct sound from the stereophonic loudspeakers 10 and 11 and the reflected sound caused by the complicated shape of the interior space 7 of the motor vehicle are composed due to the reflection composite effect. Therefore, the reflected composite signal is included in the first sound picked by the microphone 19 at the listening position. Thus, the propagating time of the reflected composite signal can be obtained as the time lag $\tau 1$ between the acoustic signal Sm and the extracted audio signal S3.

Thereafter, the sound field correcting signal Sc is fed to the sound field correcting loudspeaker 13 through the amplifier 16 to resume the operation thereof, and the supply of the audio signals $S_L$ and $S_R$ to the loudspeakers 10 and 11 is temporarily stopped. Thus, a sound field caused only by the sound field correcting signal Sc is created in the space 7, thereby generating the second sound.

The microphone 19 picks up the second sound and applies it to the control circuit 20 as the acoustic signal Sm. At the correlation calculator 20*a* of the control circuit 20, the cross correlation between the digital data Dm' and the digital data D3 is calculated. Thus, the time lag $\tau 2$ between the acoustic signal Sm and the extracted audio signal S3 is calculated. Accordingly, the time it takes for the sound emitted from the loudspeaker 13 included in the second sound to reach the listening position is obtained.

The difference $(\tau 1-\tau 2)$ between the time lag $\tau 1$ and $\tau 2$ is further calculated at the control circuit 20. The time it takes for the adder 21, phase adjusting circuit 22, extracting circuit 23, and the amplitude adjusting circuit 25 to execute the operation is further added to the difference $(\tau 1-\tau 2)$ to obtain the delay time $\Delta\tau$ which is applied to the delay circuit 24. Thus the delay time of the extracted audio signal S3 is determined.

Meanwhile, the frequency fp of the reflected composite signal included in the first sound is calculated in accordance with the aforementioned equations (1) and (2). Thus the pass band BF of the extracting circuit 23 is determined.

Thereafter, the stereophonic loudspeakers 10 and 11 are operated with the sound field correcting loudspeaker 13, and the resultant sound is picked up by the microphonre 19. At the difference calculator 20*d*, the difference between the square of the acoustic data Dm' based on the acoustic signal Sm from the microphone 19 and the square of the extracted audio data D3 based on the audio signal S3 is calculated, thereby obtaining the absolute value $\epsilon$ in accordance with the aforementioned equation (3). The absolute value $\epsilon$ is applied to the amplitude adjusting circuit 25, thereby adjusting the amplitude of the delayed audio signal Sc so as to render the absolute value $\epsilon$ minimum. By thus adjusting the amplitude of the sound field correcting signal, the sound pressure level of the reflected composite signals $S_L$ and $S_R$ and the sound pressure level of the second sound at the listening position can be rendered equal.

When the adjustments are thus made of the phase, delay time and the amplitude, the sound field correcting signal Sc is fed to the sound field correcting loudspeaker 13 thereby emitting the second sound. The second sound has the opposite phase to that of the reflected composite signal included in the first sound and the same amplitude when reaching the listening position.

Moreover, since the pass band BF of the extracting circuit 23 coincides with the frequency range in which the reflected composite signal exists, the second sound comprises components in the same frequency range as the reflected composite signal.

In addition the delay time $\Delta\tau$ set at the delay circuit is substantially equal to the difference between the time lag of the reflected composite signal and the time lag of the second sound. Hence, the second sound reaches the listening position at the same time as the reflected composite signal.

The sound pressure level of the second sound is so determined at the amplitude adjusting circuit 25 as to be equal to that of the first sound.

Since the second sound has substantially the same sound pressure level as the reflected composite signal, but with the opposite phase, the reflected composite signal is substantially completely canceled by the second sound. Thus, disturbing muffled sound in the low frequency range which had been a problem in the conventional system can be largely reduced. Moreover, due to the reduction of the reflected composite signal, the sound pressure levels at positions adjacent the rear seat 12 is decreased, thereby rendering it possible to provide a uniform sound field characteristic in the entire interior space 7 of the vehicle.

The assessments of the audio system of the present invention are now described with reference to the graphs shown in FIGS. 2*a* to 3*b*.

Figure 2A:
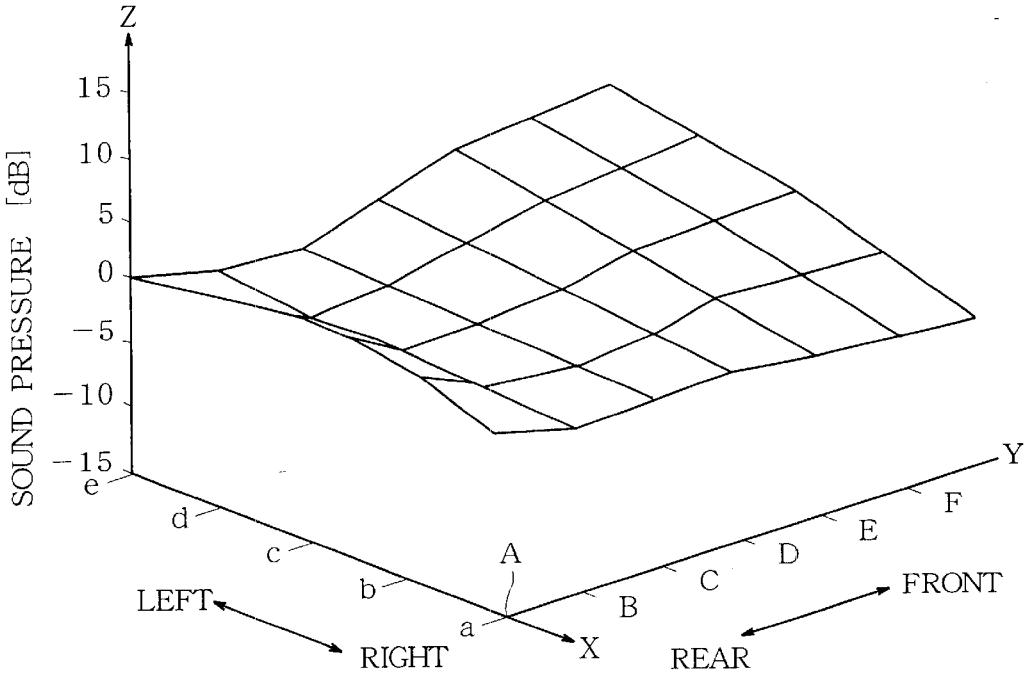
FIGS. 2*a* and 2*b* are graphs showing characteristics of sound fields created when a sound field correcting speaker of the present invention is operated and when the sound field correcting speaker is not operated.
Figure 2B:
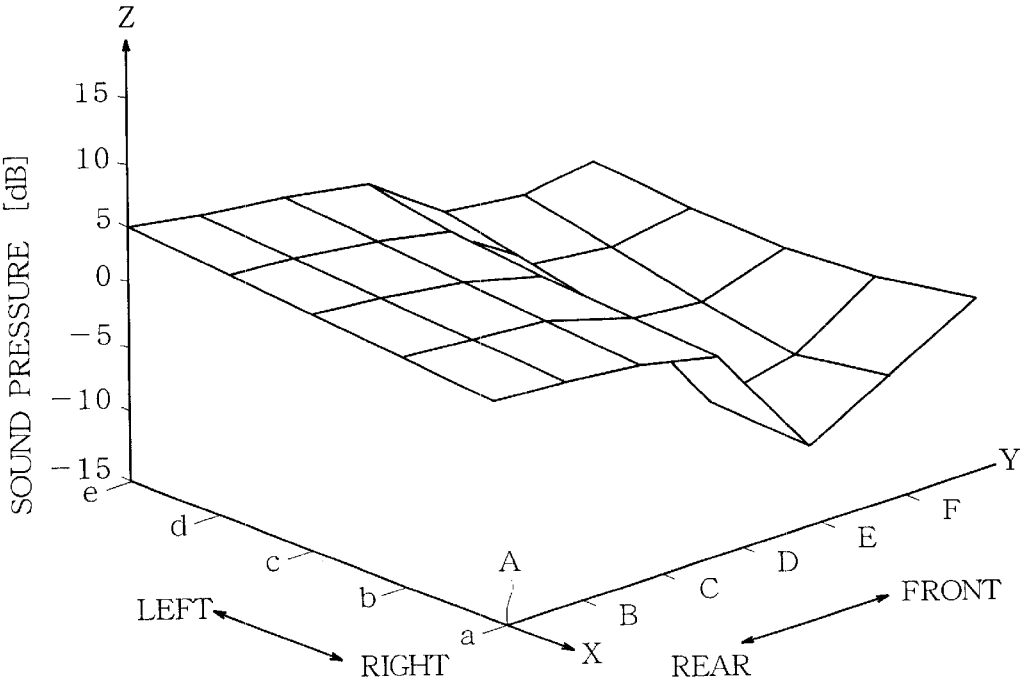

FIG. 2*a* shows the sound field characteristics in the interior space 7 when the correction of the sound field is carried out by operating the sound field correcting loudspeaker 13, and FIG. 2*b* shows the sound field characteristics when the operation of the sound field correcting loudspeaker 13 is stopped.

Both of the graphs show the characteristics when the frequency of the reflected composite signal caused by the reflection composite effect is about 68 Hz. In the graphs, the coordinate axis X shows the lateral direction of the vehicle, the coordinate axis Y, the longitudinal direction, and the coordinate axis Z, relative sound pressure levels at respective positions when an average sound pressure level is 0 dB. In the axis Y, the reference F designates front of the vehicle, and the reference A designates the rear. The coordinates E-a indicate the position of a head rest at the driver's seat 9 while the coordinates E-e indicate the position of a head rest of the front passenger seat 8. The coordinates A-a and A-e indicate the positions of two head rests of the rear seat 12.

FIG. 2*b* clearly shows that, when the sound field correcting speaker 13 is not operated, the sound pressure level at the rear seat 12 is higher than at the front seats 8 and 9. Hence a uniform sound field characteristic in the interior space 7 cannot be obtained. On the other hand, when the speaker 13 is operated, a substantially uniform sound field characteristic is obtained as shown in FIG. 2*a*. The effectiveness of the present invention is thus confirmed by the experiment.

More particularly, in FIG. 2*b*, the relative sound pressure level with respect to the average pressure level of 0 dB at the coordinates A-a was +5 dB, and at the coordinates E-a, −13 dB. At the coordinate F-a, the relative sound pressure level was −6 dB and at the coordinates F-e −4 dB.

To the contrary, in FIG. 2*a*, the relative sound pressure level with respect to the average pressure level of 0 dB at the coordinates A-a was −2 dB, at the coordinates F-a, 0 dB, and at the coordinates F-e, +2 dB. Thus, thee effect of the present invention is also numerically confirmed.

Figure 3A:
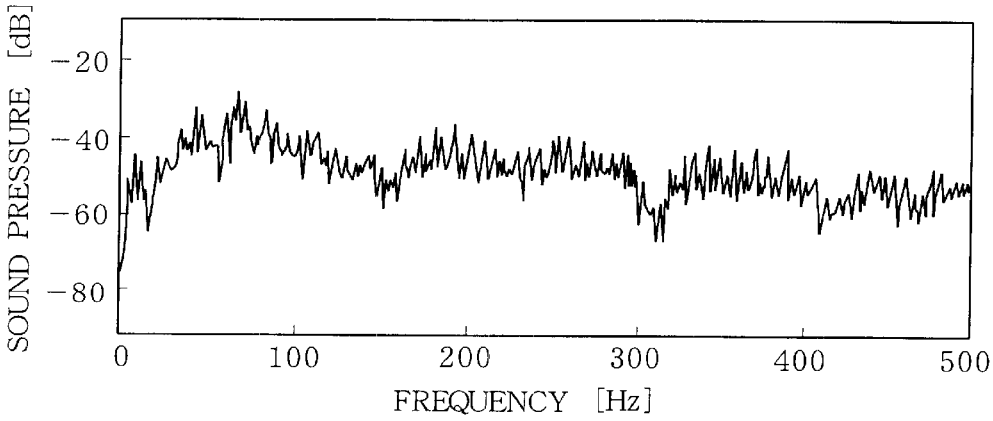
FIGS. 3*a* and 3*b* are graphs showing frequency responses in sound fields created when the sound field correcting speaker of the present invention is operated and when the sound field correcting speaker is not operated.
Figure 3B:
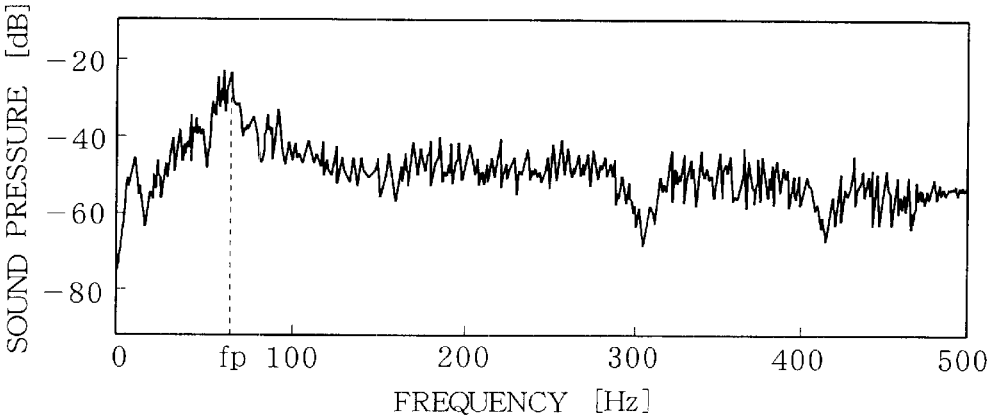
Figure 4:
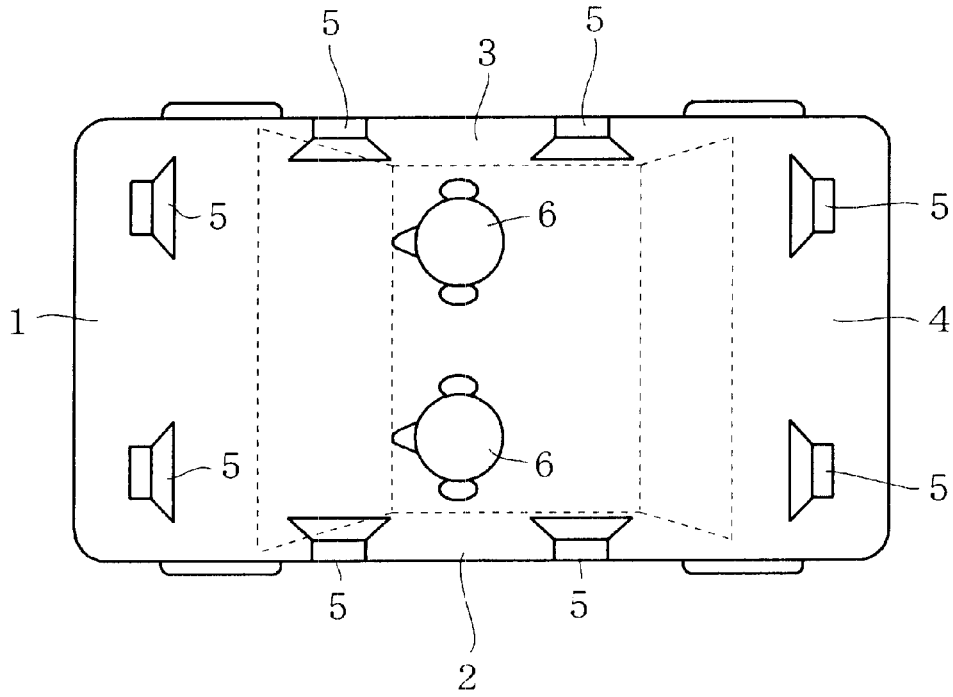
FIG.4 PRIOR ART
FIG. 4 is an illustration schematically showing an arrangement of loudspeakers in a motor vehicle in accordance with a conventional audio system.

FIGS. 3*a* and 3*b* show the frequency responses at the listening position adjacent the rear seat 12 when the sound field correcting operation is carried out and when the operation is stopped, respectively.

As shown in FIG. 3*b*, when the sound field correcting loudspeaker 13 is not operated, the sound pressure level of components of the reflected composite signal in a range adjacent the frequency fp of 68 Hz is increased. Thus, the disturbing sound is heard adjacent the rear seat 12. On the other hand, when the sound field is corrected by operating the speaker 13, the sound pressure of the component in the range adjacent the frequency fp of 68 Hz is decreased as shown in FIG. 3*a*. Thus the disturbing sound heard near the rear seat is restrained.

If the audio system of the present invention is mounted on such a vehicle as a wagon, where the seats 8, 9 and 12 are disposed at the front of the vehicle, and the package space is provided at the rear, the distances from the speakers 10 and 11 to the listening position may be longer than the distance from the speaker 13 to the listening position. In much an exceptional case, the delay time set at the delay circuits 14*a* and 15*a* is so adjusted that the time taken for the first sound from the speakers 10 and 11 to reach the listening position becomes longer than the time taken for the second sound from the speaker 13 to reach the listening position.

Thus, even in a motor vehicle such as the wagon, the sound field can be corrected with substantially the same arrangement of the loudspeakers as that shown in FIG. 1, thereby providing a uniform sound characteristic and preventing offensive sounds.

Although the sound field correcting circuit 18 of the present embodiment automatically generates the second sound which cancels the reflected composite signal, the present invention may be modified so that one or more of the circuits 21 to 25 is manually adjusted by the user. Hence more delicate adjustments of delay time and sound pressure level of the second sound can be performed so as to restrain generation of the reflected composite signal with more accuracy. Moreover, the sound field characteristics may be set to the taste of the user.

In the above-described embodiment of the invention, the control circuit 20 is provided with the correlation calculator 20*a*, phase adjuster 20*b*, extracting section 20*c* and the difference calculator 20*d* to determine parameters to the band pass filter, such as the delay time and the pass band for automatically generating an optimum sound field correcting signal Sc. However, in a second embodiment of the present invention, the information necessary for rendering the second sound identical to the reflected composite signal at the listening position, such as the time lag and the absolute value $\epsilon$, the length L of the interior space, and data on the frequency fp are stored in:a ROM provided in the control circuit 20. The parameters for the phase adjusting circuit 22, extracting circuit 23,:delay circuits 24, 14*a*, and 15*a*, and the amplitude adjusting circuit 25 may be set in accordance with these data.

By setting the frequency obtained by $\mu=2\times L$ to the band pass filter, the same effect as the first embodiment can be obtained in the second embodiment. Since only the ROM is needed in the control circuit 20 and the microphone 19 is obviated, a simple audio system for a motor vehicle can be obtained.

Furthermore, it is not necessary to provide the correlation calculator 20*a*, phase adjuster 20*b*, extracting section 20*c* and difference calculator 20*d* in the control circuit 20, and microphone 19. Thus, a simple car audio system is provided.

In the second embodiment, although the delay time and data for the pass band and amplitude adjuster are stored in the ROM, it is possible to finely adjust one or more elements from the adder 21 to amplitude adjusting circuit 25, thereby adjusting the sound field characteristic in accordance with the preference of the user.

In the heretofore described embodiments, the sound field correcting circuit 18 comprises independent circuits 21 to 25 and the control circuit 20 is operated in accordance with the program set by a microcomputer system. However, the circuits 18 and 20 of the present invention need not be confined to such constructions. For example, the sound field correcting circuit 18 and the control circuit 20 may each comprise a digital signal processor (DSP) instead of the circuits 21 to 25 and sections 20*a* to 20 so as to process digital signals. When constructing the extracting circuit 23 or the extracting section 20*c* with the DSP, either: an FIR (Finite Impulse Response) Filter or an IIR (Infinite Impulse Response) Filter may be used.

The length L of the interior space of each vehicle may be measured and the length stored in a memory such as a ROM of the audio system when leaving the factory. Alternatively, the user may measure the length L and input the measured length in the audio system.

The audio system of the present invention may be used not only on a motor vehicle, but also in a room in general.

In accordance with the audio system of the present invention, the reflected composite signal is canceled by a signal having a phase opposite thereto so that the offensive sound in the low frequency range is reduced. Hence, a uniform sound field can be obtained.

While the invention has been described in conjunction with preferred specific embodiment thereof, it will be understood that this description is intended to illustrate and not limit the scope of the invention, which is defined by the following claims.

What is claimed is:

1. An audio system for a room comprising:

a sound source;

a first speaker for emitting a first sound including a reflected composite signal based on an audio signal from the sound source;

a second speaker for emitting a second sound;

a microphone disposed at a listening position between the first and second speakers for picking up the first sound from the first speaker and the second sound from the second speaker;

control means for obtaining a time difference and a sound pressure difference between the reflected composite signal and the second sound picked up by the microphone based on characteristic information of the first and second sounds;

phase adjusting means for inverting the phase of the audio signal from the sound source for producing an antiphase audio signal;

filter means for extracting an input audio signal of a predetermined frequency band from the antiphase audio signal, in which the predetermined frequency band corresponds to a frequency band of the reflected composite signal included in the first sound picked up by the microphone;

delay means for delaying the antiphase audio signal based on the time difference so that the second sound coincides with the first sound at the microphone;

amplitude adjusting means for adjusting the amplitude of the antiphase audio signal so as to reduce the second pressure difference;

applying means for applying the inverted antiphase audio signal to the second speaker for emitting the second sound.

2. An audio system for a room comprising:

a sound source;

a first speaker for emitting a first sound based on an audio signal from the sound source;

a second speaker for emitting a second sound;

phase adjusting means for inverting the phase of the audio signal from the sound source for producing an antiphase audio signal;

filter means for extracting an input audio signal of a predetermined frequency band from the antiphase audio signal, in which the predetermined frequency band corresponds to a frequency band of a reflected composite signal included in the first sound applied to a listening position;

delay means for delaying the antiphase audio signal a delay time obtained based on a time difference between a first time lag between the audio signal from the sound source and the first sound applied to the listening position, and second time lag between the audio signal from the sound source and the second sound applied to the listening position;

amplitude adjusting means for adjusting the amplitude of the antiphase audio signal so as to approximate to the second pressure of the first sound;

applying means for applying the inverted antiphase audio signal to the second speaker for emitting the second sound.

3. The system according to claim 1 wherein the frequency band of the filter means is obtained from the following formula, $$\lambda \approx 2 \times L$$

where $\lambda$ is the wavelength and L is the length of the room.

4. The system according to claim 1 wherein the time difference of the delay means is obtained based on the time difference between a first propagation delay time and a second propagation delay time.

5. The system according to claim 1 wherein the time difference corresponds to a propagation time difference between a propagation time of the first sound to the listening position and a propagation time of the second sound to the listening position.

6. The system according to claim 1 wherein at least one of the filter means, phase adjusting means, delay means and amplitude adjusting means is provided to be externally adjusted.

7. The system according to claim 1 wherein the filter means is a band pass filter.

8. The system according to claim 1 wherein the filter means is a low pass filter.

9. The system according to claim 1 wherein the audio system is an audio system mounted on a motor vehicle.

* * * * *